US008077107B2

(12) United States Patent
Higaki et al.

(10) Patent No.: US 8,077,107 B2
(45) Date of Patent: Dec. 13, 2011

(54) ANTENNA APPARATUS

(75) Inventors: Makoto Higaki, Kawasaki (JP); Kazuhiro Inoue, Inagi (JP); Yukako Tsutsumi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 264 days.

(21) Appl. No.: 12/184,735

(22) Filed: Aug. 1, 2008

(65) Prior Publication Data

US 2009/0079654 A1 Mar. 26, 2009

(30) Foreign Application Priority Data

Sep. 21, 2007 (JP) ..... 2007-245337

(51) Int. Cl.
*H01Q 9/28* (2006.01)

(52) U.S. Cl. ..... 343/795; 343/700 MS

(58) Field of Classification Search ..... 343/793, 343/700 MS, 834, 835, 836, 837, 838, 702, 343/795

See application file for complete search history.

(56) References Cited

U.S. PATENT DOCUMENTS 5,220,334 A * 6/1993 Raguenet et al. ..... 343/700 MS
6,421,014 B1 * 7/2002 Sanad ..... 343/700 MS
6,573,867 B1 * 6/2003 Desclos et al. ..... 343/700 MS
7,453,413 B2 * 11/2008 Larry et al. ..... 343/834

FOREIGN PATENT DOCUMENTS

JP 2007-60349 3/2007

OTHER PUBLICATIONS

U.S. Appl. No. 12/623,749, filed Nov. 23, 2009, Inoue, et al.
U.S. Appl. No. 12/351,235, filed Jan. 9, 2009, Higaki, et al.
U.S. Appl. No. 12/410,768, filed Mar. 25, 2009, Suetsuna, et al.

* cited by examiner

*Primary Examiner* — Dieu H. Duong
(74) *Attorney, Agent, or Firm* — Oblon, Spivak, McClelland, Maier & Neustadt, L.L.P.

(57) ABSTRACT

There is provided an antenna apparatus including: a finite ground plane; a plate-like conductive element configured to include a first conductive plate disposed so as to oppose the finite ground plane and a second conductive plate that shorts a first edge of the first conductive plate to the finite ground plane; and an antenna configured to include an antenna element and a feeding point feeding power to the antenna element, which is positioned in the vicinity of a second edge in a side opposite to the first edge of the first conductive plate.

15 Claims, 9 Drawing Sheets

ANTENNA APPARATUS

CROSS REFERENCE TO RELATED APPLICATIONS

This application is based upon and claims the benefit of priority from the prior Japanese Patent Applications No. 2007-245337, filed on Sep. 21, 2007; the entire contents of which are incorporated herein by reference.

BACKGROUND OF THE INVENTION

1. Field of the Invention

The present invention relates to an antenna apparatus and, in particular, to profile lowering and bandwidth widening thereof.

2. Related Art

As described in JP-A 2007-60349 (Kokai), a conventional antenna apparatus includes an inverted-F antenna. With such an antenna apparatus, antenna matching is enabled even when the inverted-F antenna is given a low profile by providing a shorting metal pin near a feeding point of the inverted-F antenna. However, there is a problem in that a frequency range in which matching is attained will be limited by a small loop passing through the feeding point and the metal pin. As a result, in order to accommodate a plurality of wideband wireless systems, an antenna height suitable therefor is required.

SUMMARY OF THE INVENTION

According to an aspect of the present invention, there is provided with an antenna apparatus comprising:

a finite ground plane;

a plate-like conductive element configured to include a first conductive plate disposed so as to oppose the finite ground plane and a second conductive plate that shorts a first edge of the first conductive plate to the finite ground plane; and an antenna configured to include an antenna element and a feeding point feeding power to the antenna element, which is positioned in the vicinity of a second edge in a side opposite to the first edge of the first conductive plate, wherein the plate-like conductive element propagate an electromagnetic wave which is radiated from the antenna and incorporated into a space between the first conductive plate and the finite ground plane from the second edge side of the first conductive plate, by means of reflection between the first conductive plate and the finite ground plane toward an inside surface of the second conductive plate to reflect it on the inside surface, and propagates a reflected electromagnetic wave by means of reflection between the first conductive plate and the finite ground plane toward the second edge side of the first conductive plate to output it outside the space so that a desired phase delay is induced in the electromagnetic wave.

According to an aspect of the present invention, there is provided with an antenna apparatus comprising:

a finite ground plane;

a dielectric plate formed on the finite ground plane a plate-like conductive element configured to include a first conductive plate formed on the dielectric plate and a plurality of shortening members that shorts a first edge of the first conductive plate to the finite ground plane via through holes; and an antenna configured to include an antenna element and a feeding point feeding power to the antenna element, which is positioned in the vicinity of a second edge in a side opposite to the first edge of the first conductive plate, wherein the plate-like conductive element propagate an electromagnetic wave which is radiated from the antenna and incorporated into a space between the first conductive plate and the finite ground plane from the second edge side of the first conductive plate, by means of reflection between the first conductive plate and the finite ground plane toward an inside surface of the second conductive plate to reflect it on the inside surface, and propagates a reflected electromagnetic wave by means of reflection between the first conductive plate and the finite ground plane toward the second edge side of the first conductive plate to output it outside the space so that a desired phase delay is induced in the electromagnetic wave.

DETAILED DESCRIPTION OF THE INVENTION

Embodiments will now be described in detail with reference to the drawings.

First Embodiment

Figure 1:
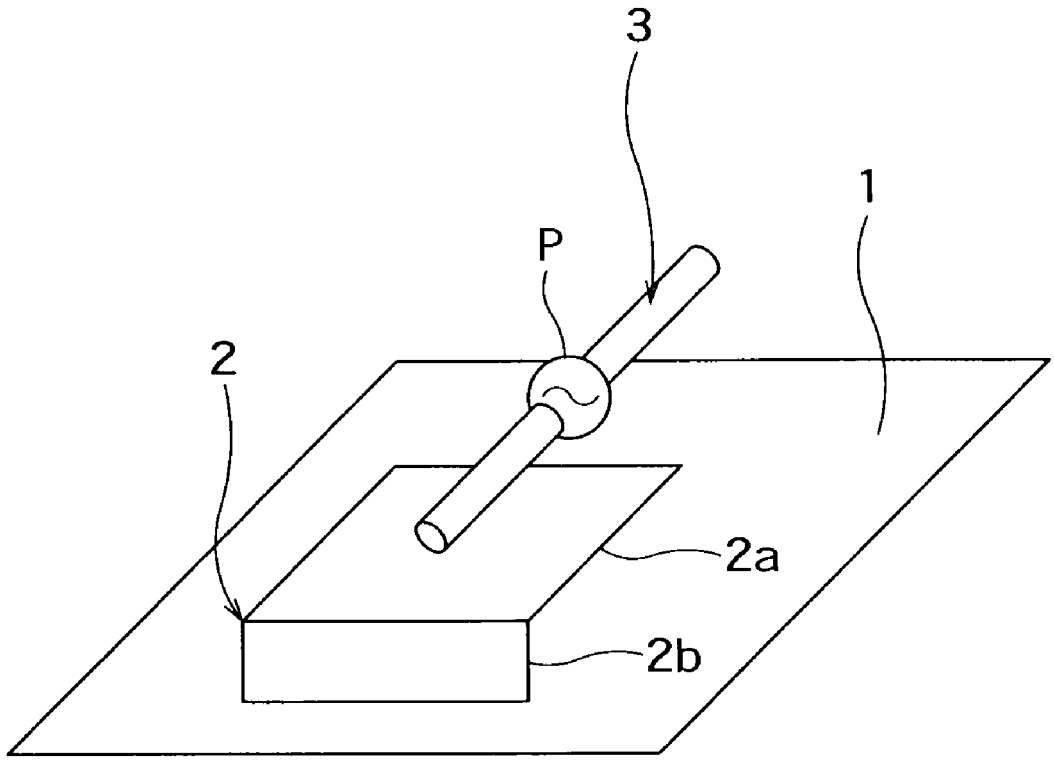
FIG. 1 is a configuration diagram of an antenna apparatus according to a first embodiment of the present invention.

FIG. 1 is a configuration diagram of an antenna apparatus according to a first embodiment of the present invention.

The present antenna apparatus includes: a finite ground plane 1, a rectangular conductive plate 2 bent midway and which one edge side thereof is shorted to the finite ground plane 1 and the other edge side is open; and a dipole antenna 3 disposed parallel to the finite ground plane 1 and whose feeding point is positioned near the other edge side (i.e., a side farthest from the side shorted to the finite ground plane 1) of the rectangular conductive plate 2.

The finite ground plane 1 is made of conductive material. As will be described later, a mechanism realizing a low profile/wide bandwidth antenna depends on the rectangular conductive plate 2. Since the profile lowering issue occurs, to begin with, because of the existence of the finite ground plane 1, the size of the finite ground plane 1 is not a design factor. The size of the finite ground plane at which the profile lowering issue occurs is equal to or greater than about ¼ wavelength of a used wavelength, with no upper limit. When the size of the finite ground plane is equal to or less than about ¼ wavelength, the profile lowering issue does not occur. Accordingly, in the present embodiment, it is assumed that the size of the finite ground plane is equal to or greater than about ¼ wavelength of the used wavelength.

The rectangular conductive plate 2 is made of rectangular-shaped conductive material. The rectangular conductive plate 2 is bent as shown in the diagram and is made of a portion 2*a* parallel to the finite ground plane 1 (first conductive plate) and a portion 2*b* perpendicular to the finite ground plane 1 (second conductive plate). An entire side of an open end side of the perpendicular portion 2*b* is shorted to the finite ground plane 1. The first conductive plate and the second conductive plate form, for example, a plate-like conductive element. As long as electrically equivalent, instead of bending, two rectangular conductive plates may be prepared wherein the two planes are electrically connected using a method such as soldering. In addition, although the rectangular conductive plate 2 in the present example is bent at a right angle and is configured by a parallel portion 2*a* and a perpendicular portion 2*b* with respect to the finite ground plane 1, this configuration is not essential. The rectangular conductive plate 2 is not limited to any particular shape as long as electromagnetic wave propagation, to be described later, is obtained in the space between the rectangular conductive plate and the finite ground plane 1.

The dipole antenna 3 is a generally well-known basic antenna having two linear conductors (antenna elements) aligned in a single straight line and a feeding point P disposed therebetween. In other words, the dipole antenna 3 includes two antenna elements and the feeding point P which feeds the antenna elements. The dipole antenna 3 is disposed such that the distance to the finite ground plane 1 is equal to or greater than the distance between the conductive plate 2*a* and the finite ground plane 1. The feeding point P is positioned in the vicinity of the other end of the first conductive plate 2*a*. While one linear conductor of the dipole antenna 3 overlaps with the conductive plate 2*a* and the longitudinal direction of the linear conductor coincides with the longitudinal direction of the conductive plate 2*a*, this is merely one form of arrangement and the present invention is not limited to such an arrangement. For example, a form is also possible wherein the dipole antenna 3 is rotated 90 degrees with the feeding point P as an axis so as to be parallel to the finite ground plane 1. Positioning the feeding point P in the vicinity of the other edge side of the conductive plate 2*a* shall suffice, preferably at on outer side of the other edge side (so that the feeding point and the conductive plate 2*a* are planarly separated). The bandwidth of the dipole antenna 3 is controllable in a length in the perpendicular direction of the second conductive plate 2*b* of the rectangular conductive plate 2. In addition, antenna matching is easily adjustable by relative positions of the dipole antenna 3 and the rectangular conductive plate 2.

Figure 2:
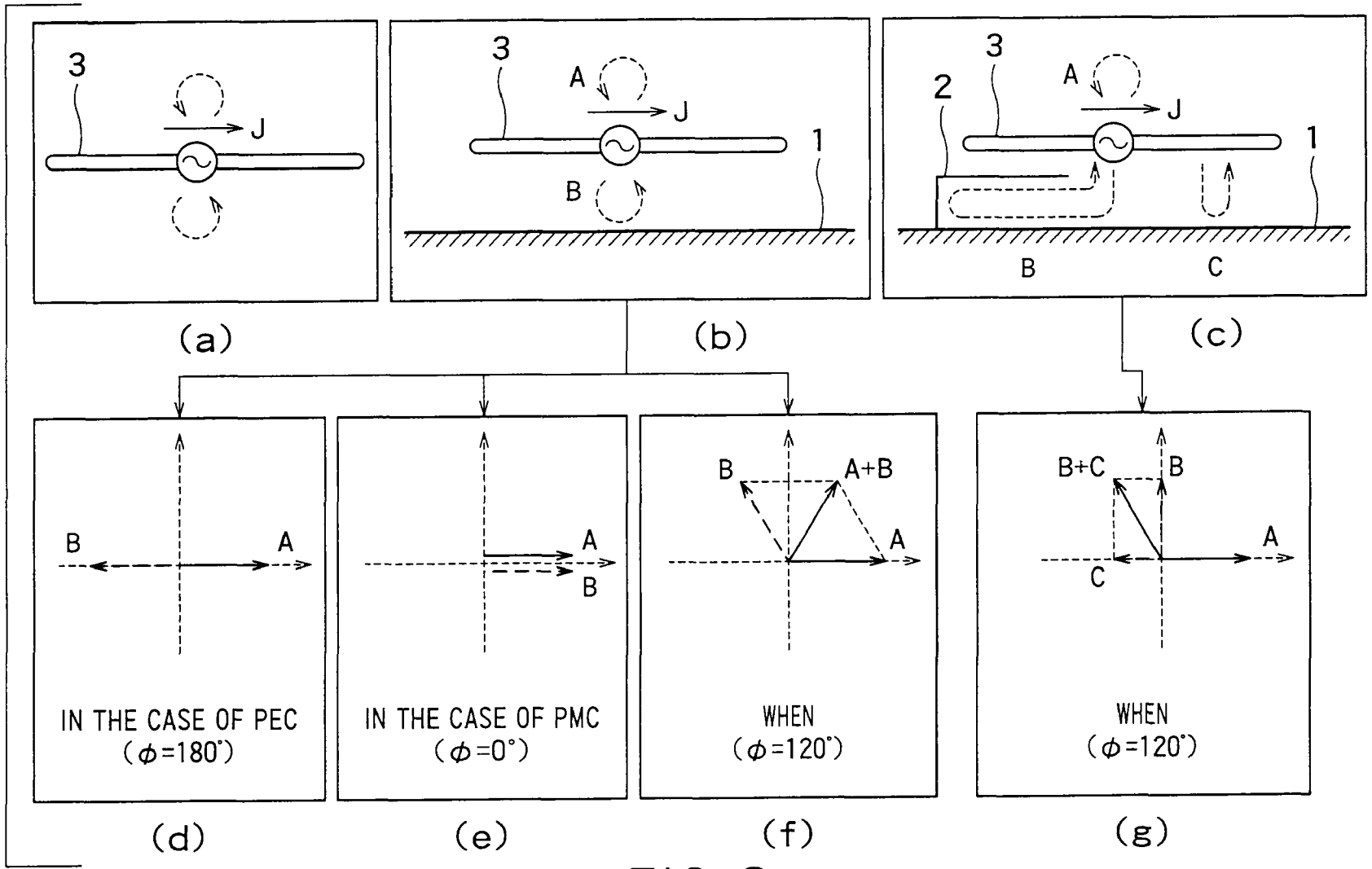
FIG. 2 is a side view illustrating an operating principle of the antenna apparatus according to the first embodiment of the present invention.

FIG. 2 is an explanatory diagram of an operating principle of the antenna apparatus shown in FIG. 1.

FIG. 2(*a*) shows a case where the dipole antenna 3 exists in free space. When assuming a current J on the dipole antenna 3, an electrical field created by the current J causes a voltage Vo to be generated at the feeding point. Consequently, an input impedance Zo=Vo/J of the dipole antenna 3 is determined which, in the case of a half-wave dipole antenna, is known to be approximately 72 Ω.

FIG. 2(*b*) shows a case where the dipole antenna 3 is disposed parallel on the finite ground plane 1. Two electrical fields are conceivably generated by the current J, namely, an electrical field generated on a side of a semi-infinite free space above the dipole antenna 3, and an electrical field generated by reflection off of the finite ground plane 1 on a lower side of the dipole antenna 3.

Here, an impedance when the profile of the dipole antenna is lowered differs according to a reflection phase $\phi$ at the point of reflection. In the case of a PEC (Perfect Electric Conductor) having characteristics resembling that of metal, $\phi$=180 degrees and, consequently, no voltage is generated at a profile lowering limit and an input impedance of 0 is obtained. In the case of a PMC (Perfect Magnetic Conductor), $\phi$=0 degrees and, consequently, a voltage that is twice the voltage in free space is generated at a profile lowering limit and an input impedance of 2Zo is obtained. Assuming that $\phi$=120 degrees=2π/3 rad, from a relational expression expressed as $$\exp(j\omega t)+\exp\{j(\omega t\pm 2\pi/3)\}=\exp\{j(\omega t\pm\pi/3)\},$$

an input impedance of Zo that is the same as that in free space is obtained.

FIGS. 2D, 2E and 2F are phasor representations of the above-described relationship between reflection phase and voltage. A phasor is a change in AC signals expressed in complex plane vectors, and an actual voltage magnitude can be determined by observing a real part or an imaginary part of the phasor. FIG. 2(*d*) shows how a phasor of an electrical field generated by an electromagnetic wave on a path A and a phasor of an electrical field generated by an electromagnetic wave on a path B reflected by a PEC cancel out each other at a phase difference of 180 degrees. FIG. 2(*e*) shows that a generation of an in-phase reflection at a PMC results in generation of a twofold voltage. FIG. 2(*f*) shows that a reflection of 120 degrees-phase difference does not alter voltage magnitude.

FIG. 2(*c*) is a side view of the antenna apparatus shown in FIG. 1 seen from a direction parallel to the finite ground plane 1. Since one edge side of the rectangular conductive plate 2 is shorted to the finite ground plane 1, resonance occurs at a frequency where minimum distance from short point to open end is around ¼ wavelength. At a resonance frequency of the rectangular conductive plate 2, an electromagnetic wave of path B that propagates under the rectangular conductive plate 2 as shown in FIG. 2(*c*) becomes predominant as far as power is concerned. At this point, if the profile of the rectangular conductive plate 2 is sufficiently low, a portion that passes under the rectangular conductive plate 2 among path B in a round trip is approximately half wavelength. In other words, the phase changes (delays) by approximately 180 degrees during a round trip under the rectangular conductive plate 2. In addition, since a 180 degree-reflection phase is generated at a portion of the rectangular conductive plate 2 perpendicular to the finite ground plane 1, a phase difference (delay) of approximately 360 degrees=0 degrees is generated at path B between entering to and exiting from under the rectangular conductive plate 2. This corresponds to the above-mentioned PMC. Further, by disposing the position of the antenna feeding point parallel to the finite ground plane so as to be separated from the distal end of the rectangular conductive plate 2 by about ⅙ wavelength (the state shown in FIG. 2(*c*)), a phase difference of 120 degrees is obtained in addition to the earlier phase difference of 360 degrees=0 degrees. In this manner, a phase difference of 360 degrees is obtained from the rectangular conductive plate 2 and a phase difference of 120degrees is obtained by separating the rectangular conductive plate 2 from the distal end of the dipole antenna and, in accordance with the mechanism described earlier, it is now possible to obtain an input impedance equivalent to that of a free space.

While power of the propagation path B of an electromagnetic wave due to the resonance of the rectangular conductive plate 2 is predominant, when short distance reflection (path C) from an upper surface of the finite ground plane 1 or the rectangular conductive plate 2 is not negligible, by bringing the feeding point of the dipole antenna 3 into the proximity of the distal end of the rectangular conductive plate 2 so as to shift the reflection phase of the path B towards a 0 degree-side, it is possible to arrange a combined wave of the paths B and C so as to attain a phase difference of 120 degrees.

In addition, the space between the rectangular conductive plate 2 and the finite ground plane 1 (hereinafter referred to as the space under the rectangular conductive plate 2) can be regarded as a parallel plate line. Therefore, the wider the width, the more likely that an overlap of propagation in an oblique angle (this is generally referred to as propagation mode) is excited and bandwidth widening is realized since magnitude variations with respect to frequency are inconsistent among respective propagation modes.

Consequently, it is now possible to achieve antenna matching at a low profile and, at the same time, obtain a wide band characteristic.

Second Embodiment

Figure 3:
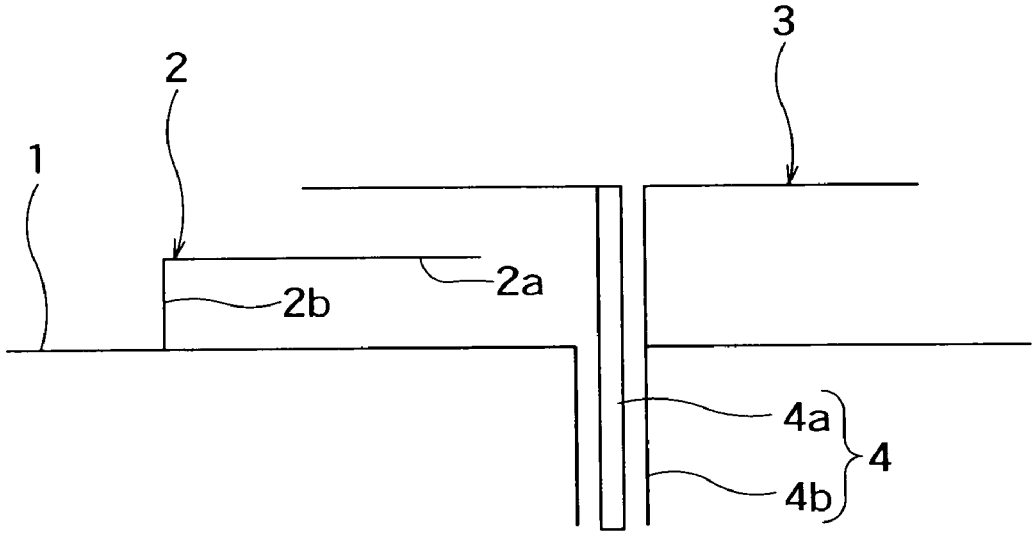
FIG. 3 is a configuration diagram of an antenna apparatus according to a second embodiment of the present invention.

FIG. 3 is a configuration diagram of an antenna apparatus according to a second embodiment of the present invention.

In the second embodiment, a coaxial line 4 has been added as a specific method for feeding the dipole antenna 3 according to the first embodiment. FIG. 3 is arranged as a side view so that a vicinity of the coaxial line 4 is easily viewable. Aside from the coaxial line 4, the structure is exactly the same as that shown in FIG. 1.

Since components other than the coaxial line 4 are the same as those in the first embodiment, a description thereof will be omitted.

The coaxial line 4 is configured by an inner conductor 4*a* made of a linear conductor and an outer conductor 4*b* made of a conductor that cylindrically surrounds a lateral surface of the inner conductor. Generally, in most cases, dielectric material is filled between the inner conductor 4*a* and the outer conductor 4*b* so as to mechanically retain a spacing between the inner conductor 4*a* and the outer conductor 4*b* and to insulate the two from each other. The inner conductor 4*a* is connected to one of the linear conductors of the dipole antenna 3, while the outer conductor 4*b* is connected to the other linear conductor and is shorted by the finite ground plane 1. The coaxial line 4 penetrates the finite ground plane 1.

Since the dipole antenna 3 is a balanced antenna and the coaxial line 4 is an unbalanced line, when connecting the two, a leaking current from the dipole antenna 3 is generated on a surface of the coaxial line 4. For this reason, a balance-unbalance converter referred to as a balan is generally inserted between the dipole antenna 3 and the coaxial line 4. However, since the rectangular conductive plate 2 shown in FIG. 3 acts as a balan, a leading current is not generated. Accordingly, it is possible to suppress leading current to the coaxial line 4 even without providing a balan.

As shown, according to the present embodiment, antenna matching at a low profile and a wide band characteristic thereof can be obtained in the same manner as the first embodiment and, at the same time, leaking current to the coaxial line 4 that is a feeder line can be suppressed. In other words, an antenna apparatus can be realized that is free of leakage to the feeding line and which enables antenna matching and self-balance-unbalance conversion (without requiring a balan) at the same time.

Third Embodiment

Figure 4:
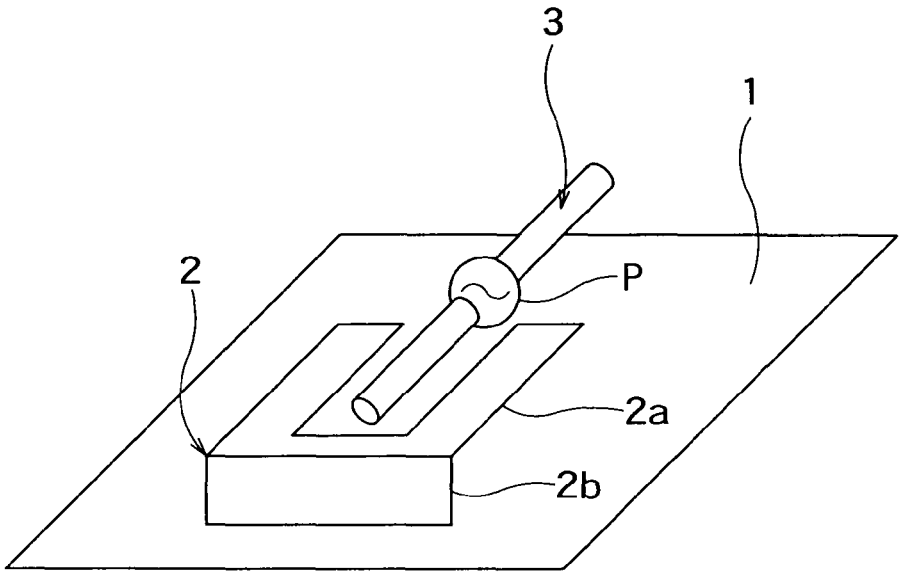
FIG. 4 is a configuration diagram of an antenna apparatus according to a third embodiment of the present invention.

FIG. 4 is a configuration diagram of an antenna apparatus according to a third embodiment of the present invention.

A feature of the third embodiment is that a notched portion has been provided at the rectangular conductive plate 2 according to the first embodiment.

Since all of the components except the rectangular conductive plate 2 are the same as those in the first embodiment, a description thereof will be omitted.

A notch is formed on the rectangular conductive plate 2 so as to avoid shorting with the dipole antenna 3 in order to enable the portion (conductive plate) 2*a* of the rectangular conductive plate 2 that is parallel to the finite ground plane 1 and the dipole antenna 3 to be disposed on a same plane.

According to the above configuration, antenna matching at a low profile and a wide band characteristic thereof can be realized in the same manner as the first embodiment and, at the same time, since the rectangular conductive plate 2 and the dipole antenna 3 can be disposed on a same plane, further profile lowering and implementation can be easily achieved.

Fourth Embodiment

Figure 5:
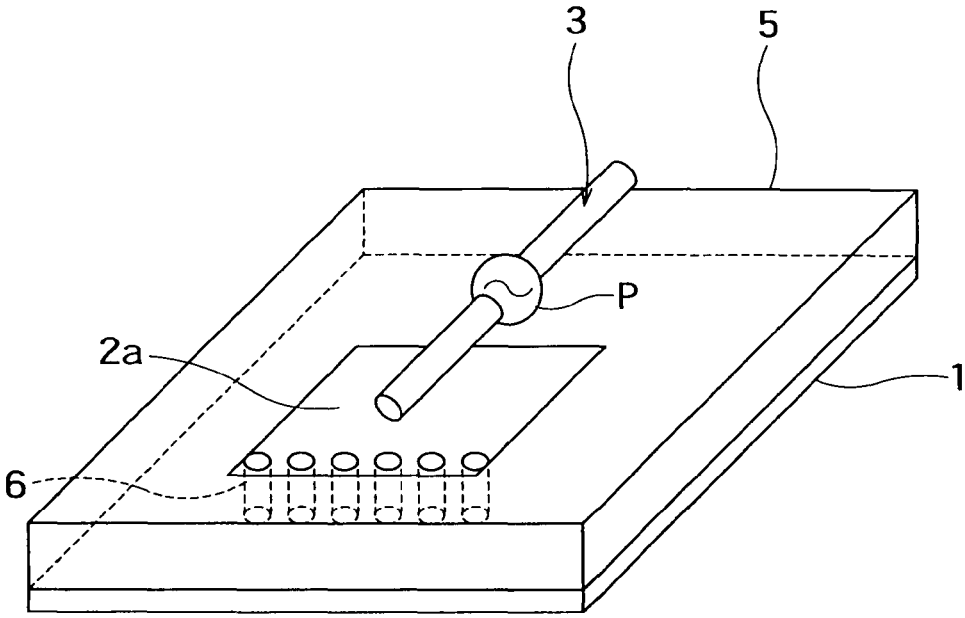
FIG. 5 is a configuration diagram of an antenna apparatus according to a fourth embodiment of the present invention.

FIG. 5 is a configuration diagram of an antenna apparatus according to a fourth embodiment of the present invention.

A feature of the fourth embodiment is that a dielectric plate 5 is provided between the finite ground plane 1 and the conductive plate 2*a* according to the first embodiment, and in place of the conductive plate 2*b* (refer to FIG. 1), a plurality of shorting members 6 that shorts an edge side of the conductive plate 2*a* to the finite ground plane 1 is formed so as to penetrate the dielectric plate 5.

Since the finite ground plane 1 is the same as that of the first embodiment, a description thereof will be omitted.

A structure (plate-like conductive element) combining the rectangular conductive plate 2 and the shorting members 6 is electrically equivalent to the rectangular conductive plate 2 according to the first embodiment. This is realized by forming a through hole using etching that is a general substrate processing technique on a dielectric substrate that originally is the dielectric plate 5 whose both surfaces are entirely covered by a metal plate, and embedding electrode material in the through hole. The plurality of shorting members 6 functions as, for example, a reflecting member that reflects an electromagnetic wave propagated through a space under the rectangular conductive plate.

The dielectric plate 5 is a member having relative permittivity $\epsilon r(\neq 1)$ which differs from that of water, and is configured by a structure that is negligible in comparison to wavelength, such as a periodic structure of metal that is minute (around 1/10 wavelength or less) in comparison to an atomic structure or wavelength. The dielectric plate 5 is responsible for downsizing due to wavelength shortening and supporting a mechanical structure.

According to the above configuration, antenna matching at a low profile and a wide band characteristic thereof can be realized in the same manner as the first embodiment and, at the same time, an entire structure can be manufactured inexpensively and easily by applying a general substrate processing technique to a general dielectric substrate.

Fifth Embodiment

Figure 6:
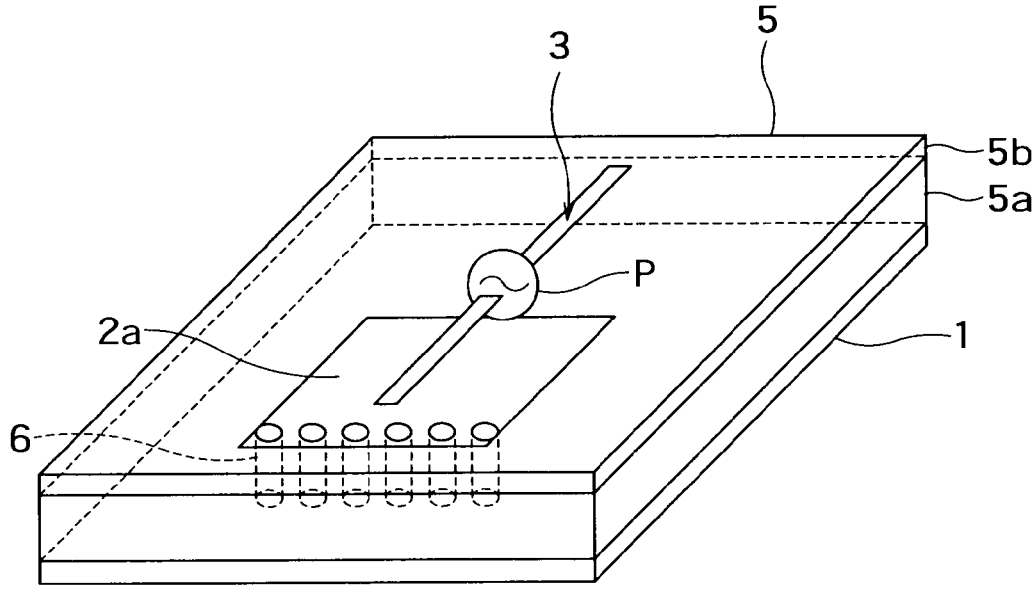
FIG. 6 is a configuration diagram of an antenna apparatus according to a fifth embodiment of the present invention.

FIG. 6 is a configuration diagram of an antenna apparatus according to a fifth embodiment of the present invention.

A feature of the fifth embodiment is that the dielectric plate 5 according to the fourth embodiment now consists of a first layer 5*a* and a second layer 5*b*, wherein the first layer 5*a*is disposed between the finite ground plane 1 and the conductive plate 2*a* while the second layer 5*b* is disposed between the conductive plate 2*a* and the dipole antenna 3.

Since components other than the dipole antenna 3 and the dielectric plate 5 are the same as those in the fourth embodiment, a description thereof will be omitted.

The dielectric plate 5 has a two-layer structure consisting of the first layer 5*a* between the finite ground plane 1 and the rectangular conductive plate 2 and the second layer 5*b* between the rectangular conductive plate 2*a* and the dipole antenna 3. The rectangular conductive plate 2 between the first layer 5*a* and the second layer 5*b* can be formed using a general multi-layer substrate processing technique.

The dipole antenna 3 is formed as a stripline on an uppermost surface of the second layer 5*b*. This can be formed by, for example, performing etching on a dielectric substrate whose uppermost surface is entirely covered by metal.

According to the above configuration, antenna matching at a low profile and a wide band characteristic thereof can be realized in the same manner as the first embodiment and, at the same time, an entire structure can be manufactured inexpensively and easily by applying a general multi-layer substrate processing technique to a general multi-layer dielectric substrate. The present embodiment may also be arranged as a single layer (only the first layer 5*a*) by providing a notch (notched portion) on the rectangular conductive plate 2 in the same manner as in the third embodiment.

Sixth Embodiment

Figure 7:
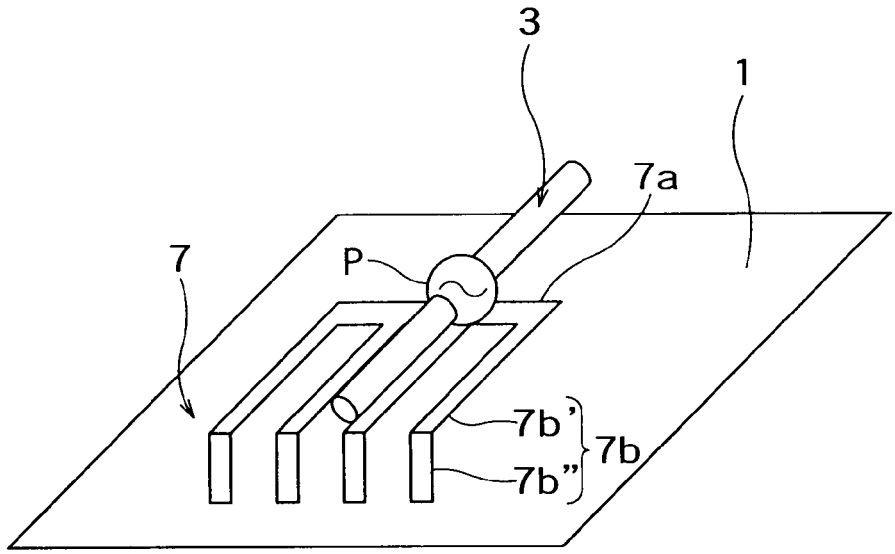
FIG. 7 is a configuration diagram of an antenna apparatus according to a sixth embodiment of the present invention.

FIG. 7 is a configuration diagram of an antenna apparatus according to a sixth embodiment of the present invention.

A feature of the sixth embodiment is that the rectangular conductive plate 2 according to the first embodiment has been replaced with a comb-like linear conductor 7.

Since components other than the comb-like linear conductor 7 are the same as those in the fourth embodiment, a description thereof will be omitted.

The comb-like linear conductor 7 is a linear conductor shaped like a so-called comb for combing one's hair, wherein a plurality of linear conductors 7*b* is perpendicularly connected from one end to the other end of a single linear conductor (first conductive element) 7*a*. The comb-like linear conductor 7 is disposed parallel to the finite ground plane 1, and distal end sides of the plurality of linear conductors 7*b* are bent and shorted to the finite ground plane 1. The linear conductors 7*b* include a portion (second conductive element) 7*b*' that is parallel to the finite ground plane 1 and whose one end is connected to the linear conductor 7*a*, and a portion (third conductive element) 7*b*" that shorts the other end of the portion 7*b*' to the finite ground plane 1.

According to the above configuration, antenna matching at a low profile and a wide band characteristic thereof can be realized in the same manner as the first embodiment and, at the same time, an advantage may be gained in that the longitudinal length of the comb-like linear conductor 7 is shorter than the longitudinal length of the rectangular conductive plate. A reason thereof will be described below.

In the case of a rectangular conductive plate, an electromagnetic wave propagating under the rectangular conductive plate is repetitively reflected between the rectangular conductive plate and a finite ground plane. Since an electromagnetic wave has a characteristic in that a tangential component of an electrical field becomes zero on a metal surface, the electrical field at a reflecting point is zero.

On the other hand, with a comb-like linear conductor, while an electromagnetic wave propagating under the comb-like linear conductor hits a non-metallic portion (gaps between the plurality of linear conductors) in some cases, the narrowness of the gaps prevents occurrences of reflections and the electromagnetic wave is reflected after minor exuding. An electromagnetic wave consists of a nonradiated field and a radiated field, and of these two, the nonradiated field exudes slightly from the gaps. With reflections at the above-described gaps, the electrical field is also zero at reflecting points.

In this case, the distance between reflecting points (path length) is equivalent to half wavelength. Therefore, compared to the case of a rectangular conductive plate, in the case of a comb-like linear conductor, reflection must occur at a smaller angle with respect to a normal of the rectangular conductive plate (a normal of a finite ground plane). This is because, when assuming that reflection occurs at the same angle in both cases, the distance between reflecting points is longer for the comb-like linear conductor due to the exuding of the electromagnetic wave. Consequently, for the distance between reflecting points to be the same (the same half wavelength length), in the case of the comb-like linear conductor, it is necessary that propagation occurs through reflection at a smaller reflecting angle with respect to the normal of the finite ground plane.

When the reflecting angle becomes smaller in this manner, phase change will occur at a shorter distance with respect to a propagation direction that is parallel to the finite ground plane. As a result, an electromagnetic wave propagating under a comb-like linear conductor has a shorter wavelength in comparison to an electromagnetic wave propagating under a rectangular conductive plate. In accordance to the shortened wavelength, the longitudinal length of the comb-like linear conductor 7 becomes shorter than the rectangular conductive plate.

Seventh Embodiment

Figure 8:
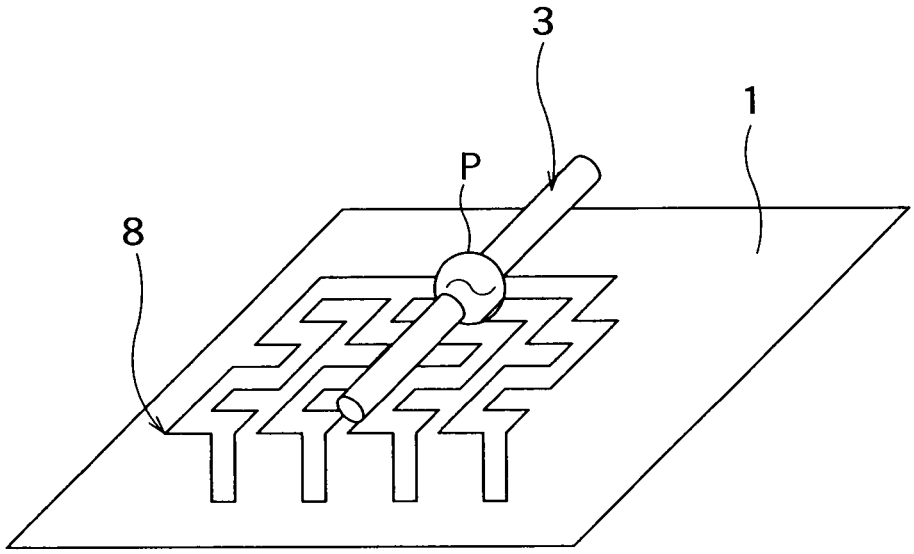
FIG. 8 is a configuration diagram of an antenna apparatus according to a seventh embodiment of the present invention.

FIG. 8 is a configuration diagram of an antenna apparatus according to a seventh embodiment of the present invention.

A feature of the seventh embodiment is that a comb-like meander-shape conductor 8 is provided wherein the plurality of linear conductors 7*b* of the comb-like linear conductor 7 according to the sixth embodiment is now given a meander shape.

Since components other than the comb-like meander-shape conductor 8 are the same as those in the fourth embodiment, a description thereof will be omitted.

The comb-like meander-shape conductor 8 is a linear conductor wherein the plurality of linear conductors 7*b* of the comb-like linear conductor 7 according to the sixth embodiment has been given a meander shape. Both the portion 7*b*' parallel to the finite ground plane 1 and the portion 7*b*" perpendicular thereto in the linear conductor 7*b* may be provided with meander shapes or, alternatively, only the former portion 7*b*' may be provided with a meander shape.

According to the above configuration, antenna matching at a low profile and a wide band characteristic thereof can be obtained in the same manner as the first embodiment and, at the same time, it is now possible to lower a frequency at which antenna matching is attained. This is because, in addition to the reasons listed for the sixth embodiment, a current path on the comb-like meander-shape conductor 8 becomes longer in comparison to a straight path that does not have a meander shape.

Eighth Embodiment

Figure 9:
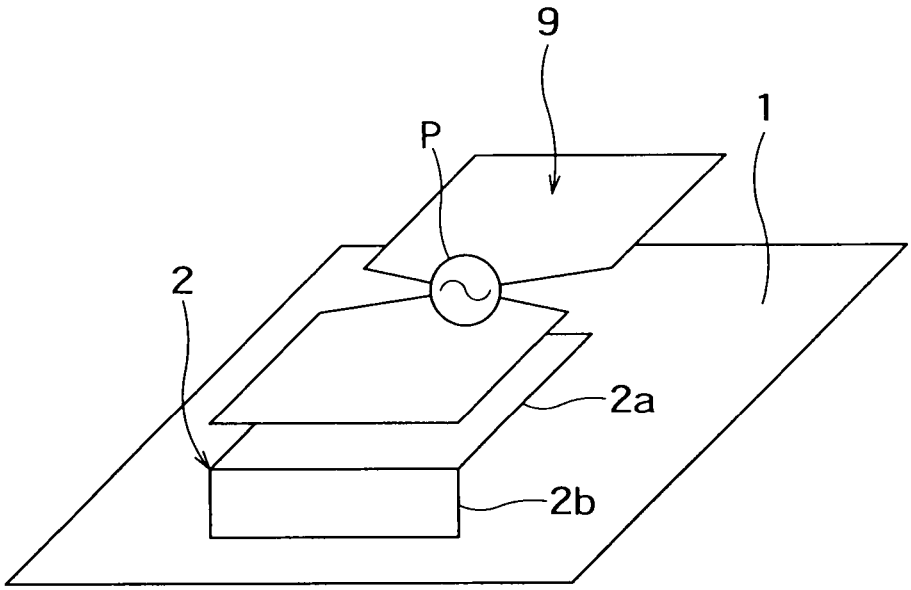
FIG. 9 is a configuration diagram of an antenna apparatus according to an eighth embodiment of the present invention.

FIG. 9 is a configuration diagram of an antenna apparatus according to an eighth embodiment of the present invention.

A feature of the eighth embodiment is that the dipole antenna 3 according to the first embodiment has been replaced with a plate-like dipole antenna 9.

Since components other than the plate-like dipole antenna 9 are the same as those in the first embodiment, a description thereof will be omitted.

The plate-like dipole antenna 9 is a variant dipole antenna wherein: two conductive plates are aligned parallel to the finite ground plane 1 so as to be mutually symmetrical; feeding is performed from a feeding point P disposed between the two conductive plates; and, from a side close to the feeding point P, the width of the two rectangular conductive plates widens obliquely the further away from the feeding point.

According to the above configuration, antenna matching at a low profile and a wide band characteristic thereof can be obtained in the same manner as the first embodiment. In addition, in the case where the bandwidth of the rectangular conductive plate 2 is wider than that of the dipole antenna, a bandwidth in which an entire structure attains antenna matching can be arranged to be wider than that of the first embodiment. In other words, by also providing the dipole antenna-side with band characteristics commensurate with the rectangular conductive plate 2, bandwidth widening as an entire antenna apparatus is now possible.

Ninth Embodiment

Figure 10:
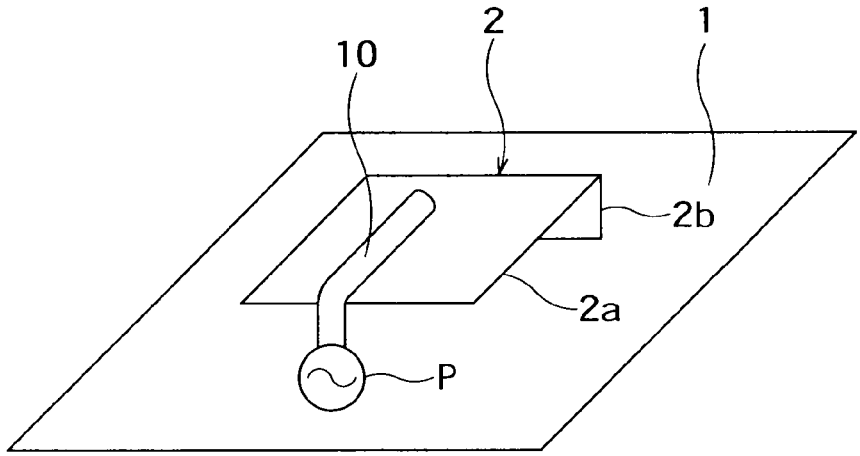
FIG. 10 is a configuration diagram of an antenna apparatus according to a ninth embodiment of the present invention.

FIG. 10 is a configuration diagram of an antenna apparatus according to a ninth embodiment of the present invention.

A feature of the ninth embodiment is that the dipole antenna 3 according to the first embodiment has been replaced with a monopole antenna 10.

Since components other than the monopole antenna 10 are the same as those in the first embodiment, a description thereof will be omitted.

The monopole antenna 10 is an antenna wherein the linear conductor on a side that is further away from the rectangular conductive plate 2 as seen from the feeding point P of the dipole antenna 3 according to the first embodiment has been removed, and a feeding point-side has been bended such that the feeding point P is connected to the finite ground plane 1. Feeding to the monopole antenna 10 is performed by, for example, a coaxial line disposed on the finite ground plane 1. In this case, an inner conductor of the coaxial line is connected to the feeding point P and an outer conductor thereof is connected to the finite ground plane 1.

According to the above configuration, antenna matching at a low profile and a wide band characteristic thereof can be obtained in the same manner as the first embodiment. In addition, downsizing of the antenna apparatus can also be achieved.

Figure 11:
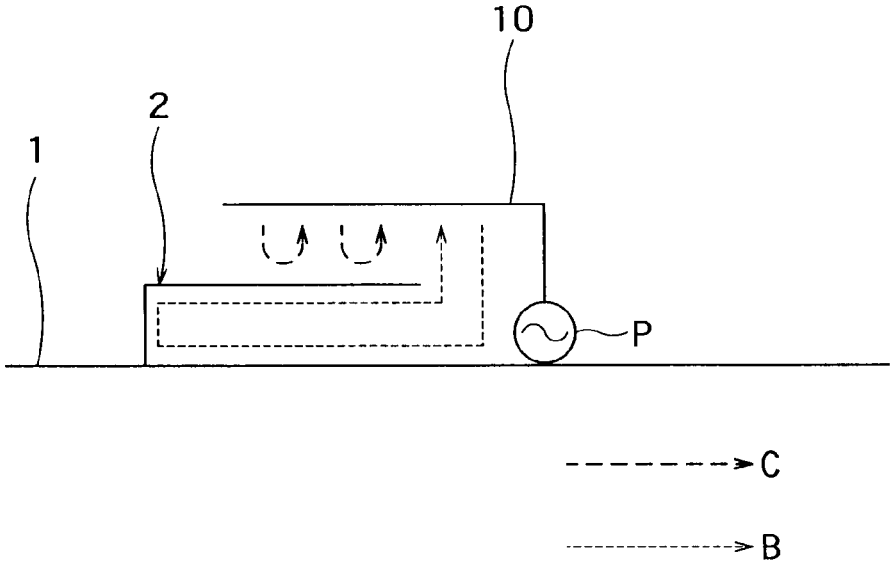
FIG. 11 is a side view illustrating an operating principle of the antenna apparatus according to the ninth embodiment of the present invention.

FIG. 11 is a side view of the antenna apparatus according to the present embodiment as seen from a side parallel to the finite ground plane 1.

To describe an operating principle of the present antenna apparatus, since the rectangular conductive plate 2 resonates at a particular frequency and an electromagnetic wave of path B which passes under the rectangular conductive plate 2 and is reflected at a 120 degree-phase is predominant at this frequency, an input impedance of the monopole antenna 10 becomes approximately the same as an input impedance in the case where the finite ground plane 1 is not placed directly under the monopole antenna 10. In addition, even in the case where a power of an electromagnetic wave of path C which is directly reflected at a short distance from an upper surface of the finite ground plane 1 directly under the monopole antenna 10 or the rectangular conductive plate 2, in the same manner as in the first embodiment, it is possible to arrange a combined wave of the paths B and C to attain a phase difference of 120 degrees by bringing the feeding point of the monopole antenna 10 into the proximity of an open end of the rectangular conductive plate 2.

Tenth Embodiment

Figure 12:
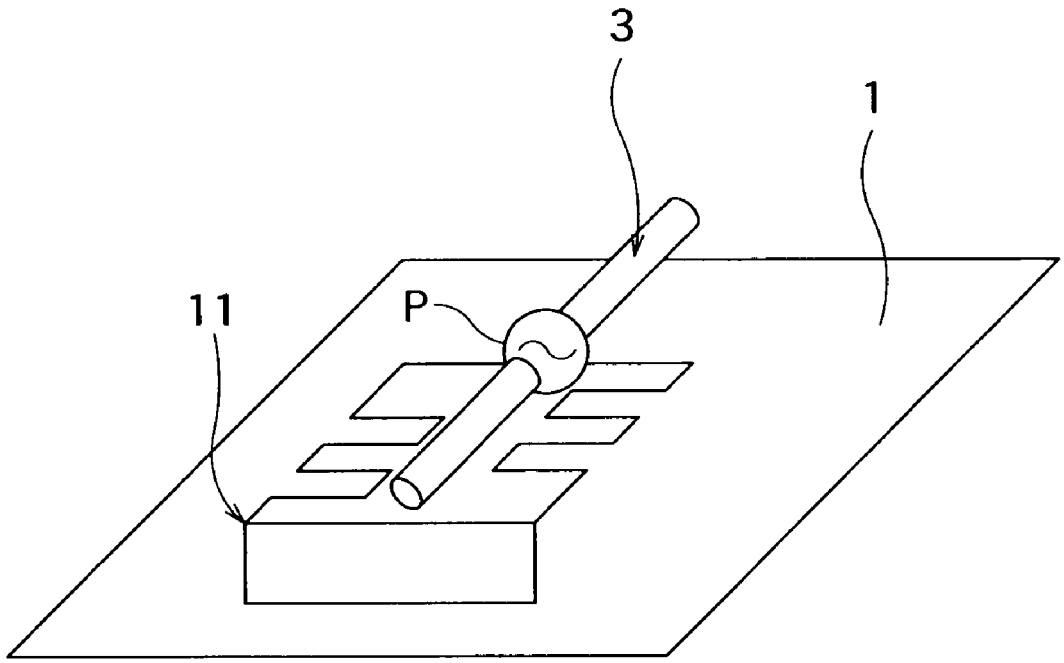
FIG. 12 is a configuration diagram of an antenna apparatus according to a tenth embodiment of the present invention.

FIG. 12 is a configuration diagram of an antenna apparatus according to a tenth embodiment of the present invention.

A feature of the tenth embodiment is that notches (notched portions) have been added to both lateral sides of the rectangular conductive plate 2 according to the first embodiment to form a notched rectangular conductive plate 11.

Since components other than the notched rectangular conductive plate 11 are the same as those in the first embodiment, a description thereof will be omitted.

The notched rectangular conductive plate 11 is the rectangular conductive plate 2 according to the first embodiment wherein a plurality of rectangular notches have been added to both lateral sides thereof. However, the present invention does not impose any restrictions on the shape of the notched portions, and the notched portions may take any shape.

According to the above configuration, antenna matching at a low profile and a wide band characteristic thereof can be obtained in the same manner as the first embodiment and, at the same time, it is now possible to lower a frequency at which antenna matching is attained. This is because a current path on the notched rectangular conductive plate 11 is longer in comparison to the case of the rectangular conductive plate 2 that is straight and notch-less.

Eleventh Embodiment

Figure 13:
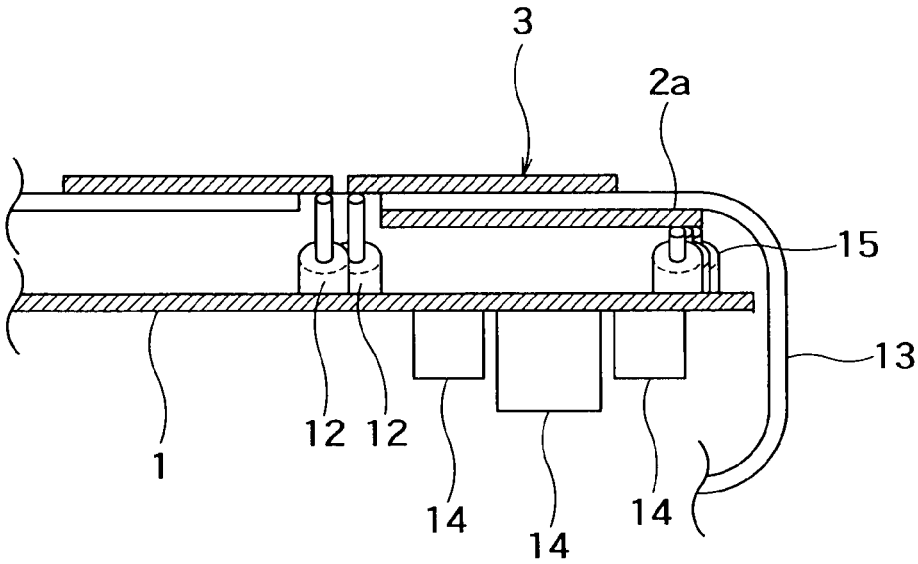
FIG. 13 is a configuration diagram of an antenna apparatus according to an eleventh embodiment of the present invention.

FIG. 13 is a configuration diagram of an antenna apparatus according to an eleventh embodiment of the present invention.

The antenna apparatus is configured by: a finite ground plane 1; a rectangular conductive plate 2*a* disposed parallel to the finite ground plane 1; a plurality of spring-loaded movable pins 15 that shorts an edge of the rectangular conductive plate 2*a*; a dipole antenna 3 disposed parallel to the finite ground plane 1 and whose feeding point is positioned in the vicinity of an other end of the rectangular conductive plate 2*a*; a plurality of spring-loaded movable pins 12 that feeds the dipole antenna 3; a chassis 13 disposed between the rectangular conductive plate 2*a* and the dipole antenna 3; and a circuit component 14 mounted on a surface on a side opposite to the rectangular conductive plate 2*a* and the dipole antenna 3 with respect to the finite ground plane 1.

Since the finite ground plane 1 is the same as that of the first embodiment, a description thereof will be omitted.

The spring-loaded movable pins 12 and 15 are general mounted components which electrically connect two components through compression bonding by means of built-in springs. In this case, one end thereof is fixed to the finite ground plane 1 and the other end is arranged as a portion movable by the spring. Consequently, a component compressed and bonded by the pin is shorted to the side of the finite ground plane 1. In addition, the spring-loaded movable pins 12 on the dipole antenna 3 side are shorted to a feeding path provided on the finite ground plane 1.

The chassis 13 is molded from plastic such as ABS resin, and is used to mechanically protect internal electronic and wireless circuits and to improve appearance.

The rectangular conductive plate 2*a* is shorted to the finite ground plane 1 by the spring-loaded movable pins 12 and is fixed between the chassis 13 by the compression force of the springs.

The dipole antenna 3 is configured of a metal plate and is adhered to an outer side of the chassis 13.

Figure 14:
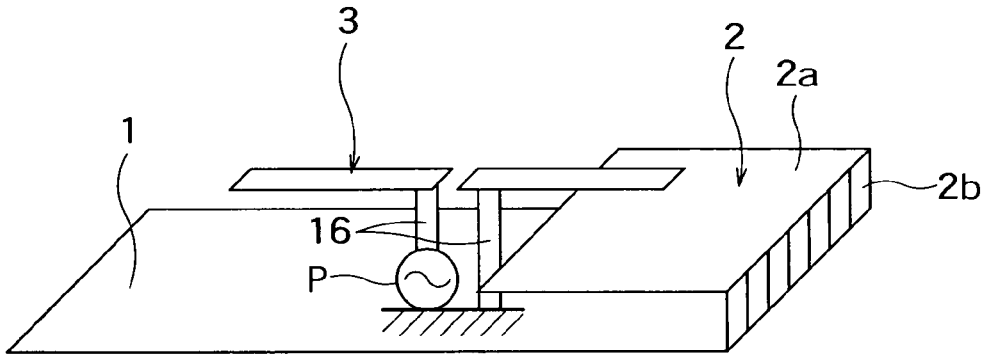
FIG. 14 is a schematic diagram of a structure that is electrically equivalent to the antenna apparatus according to the eleventh embodiment of the present invention.

A structure that is electrically equivalent of a structure consisting of the finite ground plane 1, the rectangular conductive plate 2*a*, the dipole antenna 3 and the spring-loaded movable pins 12 and 15 described above is shown in FIG. 14. A conductive portion 2*b* connected to the rectangular conductive plate 2*a* and which is perpendicular to the finite ground plane 1 corresponds to the spring-loaded movable pin 15 shown in FIG. 13. The conductive portion 2*b* perpendicular to the finite ground plane 1 is given a linear (strip-shaped) shape. With the dipole antenna 3, a portion parallel to the finite ground plane 1 is given a stripline shape while portions 16 perpendicular thereto are given a linear (strip-shaped) shape. One of the two perpendicular portions 16 is shorted to the finite ground plane 1, and the other is connected and shorted to a feeding point P. The perpendicular portions 16 correspond to the spring-loaded movable pins 12 shown in FIG. 13.

The circuit component 14 is an LSI, an inductor, a capacitor, or the like, and is a unit element constituting an electronic circuit or a wireless circuit.

According to the above configuration, antenna matching at a low profile and a wide band characteristic thereof can be obtained in the same manner as the first embodiment and, at the same time, it is now possible to suppress interference between the dipole antenna 3 and a circuit mounted on a side opposite to the dipole antenna 3 with respect to the finite ground plane 1.

It is to be understood that the present invention is not just limited to the embodiments described above, and in an embodiment phase, the present invention can be implemented by modifying components without departing from the gist thereof. In addition, various inventions can be formed by appropriately combining the plurality of components disclosed in the embodiments described above. For example, several components among all of the components illustrated in the embodiments may be deleted. Furthermore, components across different embodiments may be appropriately combined.

What is claimed is:

1. An antenna apparatus comprising:

a finite ground plane;

a plate-like conductive element configured to include a first conductive plate disposed so as to oppose the finite ground plane and a second conductive plate that shorts a first edge of the first conductive plate to the finite ground plane;

an antenna configured to include an antenna element, and a feeding point feeding power to the antenna element, which is positioned in the vicinity of a second edge in a side opposite to the first edge of the first conductive plate; and a coaxial line configured to feed the feeding point, wherein the plate-like conductive element propagates an electromagnetic wave which is radiated from the antenna and incorporated into a space between the first conductive plate and the finite ground plane from the second edge side of the first conductive plate, by means of reflection between the first conductive plate and the finite ground plane toward an inside surface of the second conductive plate to reflect the electromagnetic wave on the inside surface, and propagates a reflected electromagnetic wave by means of reflection between the first conductive plate and the finite ground plane toward the second edge side of the first conductive plate to output the electromagnetic wave outside the space so that a desired phase delay induced in the electromagnetic wave, the antenna is a dipole antenna having two antenna elements and the feeding point, an outer conductor of the coaxial line is connected to one of the two antenna elements and is shorted by the finite ground plane, and an inner conductor of the coaxial line is connected to the other one of the two antenna elements.

2. The apparatus according to claim 1, wherein the desired phase delay is induced so that a combined wave of (a) the electromagnetic wave outputted from the space, (b) an electromagnetic wave radiated from the antenna and directly reflected on the finite ground plane and (c) an electromagnetic wave radiated from the antenna and directly reflected on an upper surface of the first conductive plate has a phase difference of approximately 120 degrees with respect to an electromagnetic wave radiated from the antenna to a free space in a side opposite to the finite plate.

3. The apparatus according to claim 1, wherein the feeding point separates from the first conductive plate in a planar view.

4. The apparatus according to claim 1, wherein the two antenna elements are disposed in a straight line-like manner at a height equal to or higher than that of the first conductive plate, and the feeding point is placed between the two antenna elements, one of the two antenna elements overlaps with the first conductive plate in a planar view, and the first conductive plate has a notched part at a portion where the first conductive plate overlaps with the antenna element.

5. The apparatus according to claim 1, wherein the two antenna elements have a linear shape or a plate-like shape, respectively.

6. The apparatus according to claim 1, wherein a notched part is formed on a portion of a different edge from the first and second edges of the first conductive plate.

7. An antenna apparatus comprising:

a finite ground plane;

a plate-like conductive element configured to include a first conductive plate disposed so as to oppose the finite ground plane, and a second conductive plate that shorts a first edge of the first conductive plate to the finite ground plane; and an antenna configured to include an antenna element, and a feeding point feeding power to the antenna element, which is positioned in the vicinity of a second edge in a side opposite to the first edge of the first conductive plate, wherein the plate-like conductive element propagates an electromagnetic wave which is radiated from the antenna and incorporated into a space between the first conductive plate and the finite ground plane from the second edge side of the first conductive plate, by means of reflection between the first conductive plate and the finite ground plane toward an inside surface of the second conductive plate to reflect the electromagnetic wave on the inside surface, and propagates a reflected electromagnetic wave by means of reflection between the first conductive plate and the finite ground plane toward the second edge side of the first conductive plate to output the electromagnetic wave outside the space so that a desired phase delay is induced in the electromagnetic wave, the first conductive plate includes a first conductive element in a thin plate-like manner, and a plurality of second conductive elements in a thin plate-like manner perpendicular to the first conductive element, one edge of each second conductive element being connected to the first conductive element at different positions respectively, and the second conductive plate includes a plurality of third conductive elements in a thin plate-like manner which shorts the other edge of the second conductive elements to the finite ground plane.

8. The apparatus according to claim 7, wherein the second conductive elements has a meander shape or a strip shape, respectively.

9. The apparatus according to claim 7, wherein a notched part is formed on a portion of a different edge from the first and second edges of the first conductive plate.

10. The apparatus according to claim 7, wherein the antenna is a monopole antenna having one antenna element and the feeding point.

11. The apparatus according to claim 7, further comprising a coaxial line configured to feed the feeding point, wherein the antenna is a dipole antenna having two antenna elements and the feeding point, an outer conductor of the coaxial line is connected to one of the two antenna elements and is shorted by the finite ground plane, and an inner conductor of the coaxial line is connected to the other one of the two antenna elements.

12. The apparatus according to claim 11 wherein the two antenna elements are disposed in a straight line-like manner at a height equal to or higher than that of the first conductive plate, and the feeding point is placed between the two antenna elements, one of the two antenna elements overlaps with the first conductive plate in a planar view, and the first conductive plate has a notched part at a portion where the first conductive plate overlaps with the antenna element.

13. The apparatus according to claim 11, wherein the two antenna elements have a linear shape or a plate-like shape, respectively.

14. The apparatus according to claim 7, wherein the desired phase delay is induced so that a combined wave of (a) the electromagnetic wave outputted from the space, (b) an electromagnetic wave radiated from the antenna and directly reflected on the finite ground plane and (c) an electromagnetic wave radiated from the antenna and directly reflected on an upper surface of the first conductive plate has a phase difference of approximately 120 degrees with respect to an electromagnetic wave radiated from the antenna to a free space in a side opposite to the finite plate.

15. The apparatus according to claim 7, wherein the feeding point separates from the first conductive plate in a planar view.

* * * * *